US008653347B1

(12) United States Patent
Lewis

(10) Patent No.: US 8,653,347 B1
(45) Date of Patent: Feb. 18, 2014

(54) HEADJOINT CROWN ASSEMBLY WITH EXTENSION UNIT

(76) Inventor: Gary Wayne Lewis, San Francisco, CA (US)

( * ) Notice: Subject to any disclaimer, the term of this patent is extended or adjusted under 35 U.S.C. 154(b) by 35 days.

(21) Appl. No.: 13/571,356

(22) Filed: Aug. 10, 2012

(51) Int. Cl.
*G10D 7/02* (2006.01)

(52) U.S. Cl.
USPC ..... 84/384

(58) Field of Classification Search
USPC ..... 84/384
See application file for complete search history.

(56) References Cited

U.S. PATENT DOCUMENTS

| | | | | | |
|---|---|---|---|---|---|
| 47,582 | A | * | 5/1865 | Stratton | 84/384 |
| 444,830 | A | | 1/1891 | Guenther | |
| 734,438 | A | | 7/1903 | Skinner | |
| 859,714 | A | | 7/1907 | Wurlitzer | |
| 920,471 | A | | 5/1909 | Jenner | |
| 1,013,037 | A | | 12/1911 | Melfi | |
| 1,376,004 | A | | 4/1921 | Christensen | |
| 2,805,291 | A | | 9/1957 | Eickhorst | |
| 3,098,130 | A | | 7/1963 | Clavel | |
| 3,487,742 | A | | 1/1970 | Mills | |
| 3,763,737 | A | | 10/1973 | Sandner | |
| 4,058,046 | A | | 11/1977 | Fajardo | |
| 4,240,320 | A | | 12/1980 | Pellerite | |
| 4,499,810 | A | | 2/1985 | Ferron | |
| 4,672,878 | A | * | 6/1987 | Senior | 84/384 |

FOREIGN PATENT DOCUMENTS

| | | |
|---|---|---|
| FR | 369459 | 1/1907 |
| GB | 2563 | 0/1895 |
| GB | 6338 | 0/1832 |
| WO | WO 01/80217 A1 | 10/2001 |
| WO | WO 2005/022507 A1 | 3/2005 |

OTHER PUBLICATIONS

Rockstro, Richard The Flute, Rudall, Carte and Co., London 1890, second revised edn. 1928, reprinted by Musica Rara, London 1967. p. 154-156.

Toff, Nancy The Development of the Modern Flute, Taplinger Publishing Company, New York 1979. p. 179-182. Arthur Lora, "'Corkless' Headjoint Stopper," illustrated on p. 181.

Maclagan Susan A Dictionary for the Modern Flutist, The Scarecrow Press, Lanham 2009. Article "Bigio Crown and Stopper", p. 17. Article "Crown" including discussion of Nagahara "Locking Crown," p. 40. Article "O-ring," p. 123. Article "Stopper," p. 176.

* cited by examiner

*Primary Examiner* — Robert W Horn

(57) ABSTRACT

Crown assemblies are described, having novel extension units, selectable vibrational lengths, stoppers with flexible coupling to the crown and regulated pressure against a headjoint tube, and crowns with radial-arm contact surfaces. The novel extension units are situated between the embouchure and the crown and extend the vibrational length between those points. This extension gives the flute tone greater depth and resonance and gives the player greater control over the vibration of the flute tube. A selectable extension unit features distinct vibrational lengths at indexed points of rotation of the crown, providing a means for rapidly changing the tone and response of the instrument in a fashion heretofore unknown on flutes. Improvements to crown and stopper design allow freer vibration of the headjoint tube between embouchure and crown, further enhancing the benefits of the novel extension unit.

20 Claims, 5 Drawing Sheets

FIG. 5C
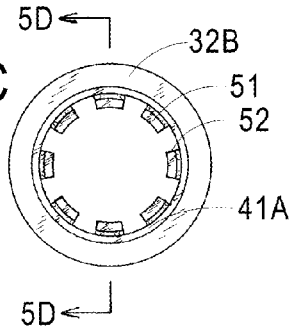
FIG. 5D
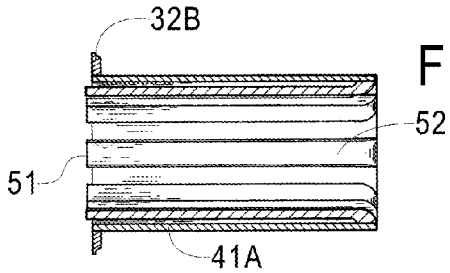
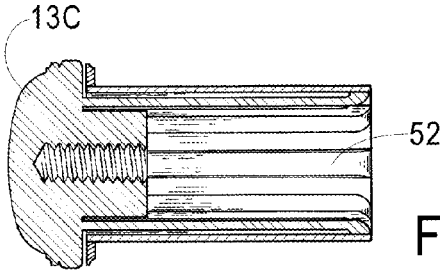
FIG. 5E
FIG. 6
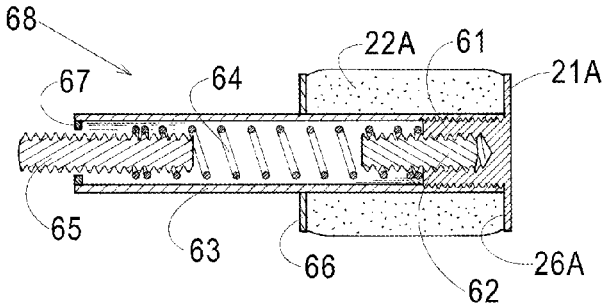
FIG. 7
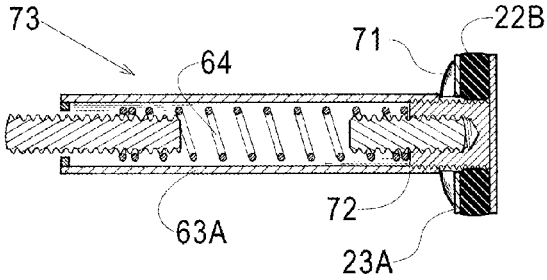

FIG. 8
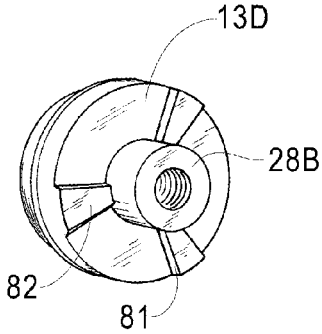
FIG. 9A
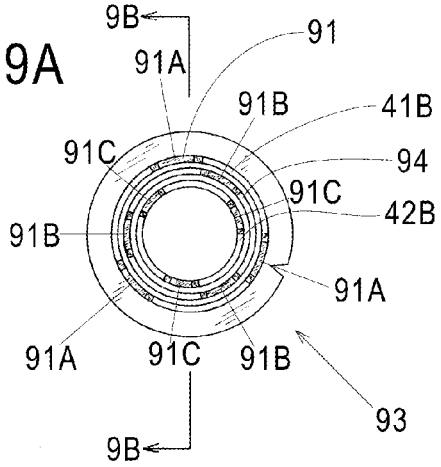
FIG. 9B
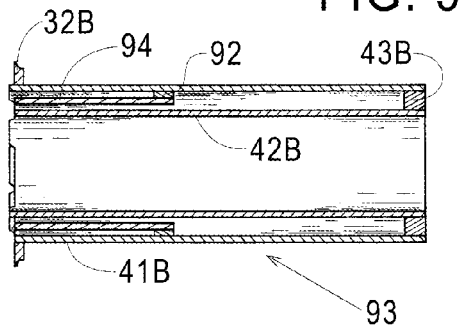
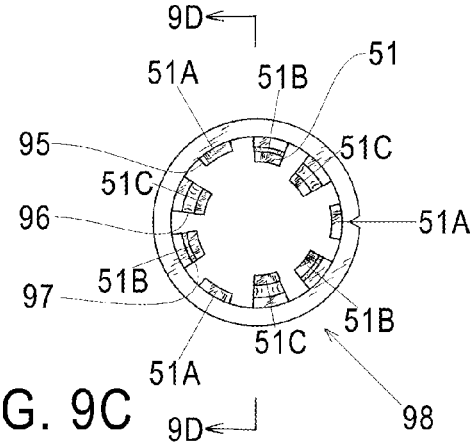
FIG. 9C
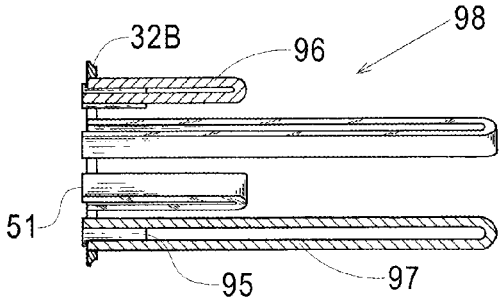
FIG. 9D

HEADJOINT CROWN ASSEMBLY WITH EXTENSION UNIT

BACKGROUND

Prior Art

The following is a tabulation of some prior art that presently appears relevant:

U.S. Patents

| Pat. No. | Kind Code | Issue Date | Patentee |
|---|---|---|---|
| 444,830 | B1 | Jan. 20, 1891 | Guenther |
| 734,438 | B1 | Jul. 21, 1903 | Skinner |
| 859,714 | B1 | Jul. 9, 1907 | Wurlitzer |
| 920,471 | B1 | May 4, 1909 | Jenner |
| 1,013,037 | B1 | Dec. 26, 1911 | Melfi |
| 1,376,004 | B1 | Apr. 26, 1921 | Christensen |
| 2,805,291 | B1 | Sep. 3, 1957 | Eickhorst |
| 3,098,130 | B1 | Jul. 16, 1963 | Clavel |
| 3,487,742 | B1 | Jan. 6, 1970 | Mills |
| 3,763,737 | B1 | Oct. 9, 1973 | Sandner |
| 4,058,046 | B1 | Nov. 15, 1977 | Fajardo |
| 4,240,320 | B1 | Dec. 23, 1980 | Pellerite |
| 4,499,810 | B1 | Feb. 19, 1985 | Ferron |

Foreign Patent Documents

| Foreign Doc. Nr. | Cntry Code | Kind Code | Pub. Date | App. or Patentee |
|---|---|---|---|---|
| 6338 (1832) | UK | | Nov. 27, 1832 | Rudall and Rose |
| 2563 (1895) | UK | | Dec. 7, 1895 | Lillicrap |
| 369459 | FR | | Jan. 12, 1907 | Couesnon et Cie |
| WO 01/80217 | WO | A1 | Oct. 25, 2001 | Dong |
| WO 2005/022507 | WO | A1 | Mar. 10, 2005 | Wilhelmus |

Nonpatent Literature Documents

Rockstro, Richard, *The Flute*, Rudall, Carte and Co., London 1890, second revised edn. 1928, reprinted by Musica Rara, London 1967. p. 154-156.

Toff, Nancy, *The Development of the Modern Flute*, Taplinger Publishing Company, New York 1979. p. 179-182. Arthur Lora, "'Corkless' Headjoint Stopper," illustrated on p. 181.

Maclagen, Susan, *A Dictionary for the Modern Flutist*, The Scarecrow Press, Lanham 2009. Article "Bigio Crown and Stopper", p 17. Article "Crown" including discussion of Nagahara "Locking Crown," p. 40. Article "O-ring," p. 123. Article "Stopper," p. 176.

This invention relates in general to headjoints for musical instruments of the flute family and in particular to crown assemblies with a novel extension unit which increases the vibrational length between embouchure and crown to give enhanced depth, resonance, and control.

Flutes of today, including concert flutes, piccolos, and alto flutes are often constructed of metal and include a body portion that is detachably connected to a headjoint. The body portion includes the body tube, finger-holes, and keys and the headjoint includes the embouchure and headjoint tube. Received in the free end of the headjoint is a crown assembly comprising a crown and stopper. The cylindrical stopper is placed at a predetermined distance from the embouchure hole. The crown is placed on the free end of the headjoint tube at a distance from the embouchure hole established by the manufacturer. The exact distance varies from maker to maker but is generally about 67 millimeters.

The stopper is held in place by action of elastic material such as cork or rubber, which expands outwardly into tight-sealing and firm-positioning engagement with the inner surface of the headjoint tube. The stopper may be formed entirely of elastic material, elastic material compressed between rigid discs, or inelastic material covered completely or in part by elastic material.

In FIG. 1, the crown is held in place by action of elastic material that expands outwardly into firm-positioning engagement with the inner surface of the headjoint.

In FIG. 2 the planar contact surface of the crown is held firmly against the free end of the headjoint tube when the crown is engaged on a threaded stem attached to the stopper. Crown, stopper, and headjoint tube are thus firmly coupled together.

It is well known that the vibration of the flute tube affects the quality and character of the flute sound and that tubes of differing thickness and material produce different tone qualities. The tube acts as a vibrational transmission line, providing a feedback mechanism for vibrations at all points of the instrument to act upon the embouchure, the critical point at which vibrations within the air column of the instrument are generated.

I have observed that the concentrated mass of the crown can serve as an anchored fulcrum for the vibrating tube much as the bridge of a guitar or violin serves as an anchored fulcrum for a vibrating string. The embouchure is the point at which the flutist drives and controls this vibration and the embouchure to crown vibrational length affects the timbre of the flute much as the bridge to bow vibrational length affects the timbre of the violin. Lengthening the embouchure to crown vibrational transmission line enhances the flutist's ability to drive and control the vibration of the tube as well as adding depth and resonance to the flute sound.

I have also observed that the tube in the area of the stopper and crown must be free to vibrate without constraint to produce the most resonant and flexible tone.

And I have observed that the crown must contact the end of the headjoint tube in such a way as to provide a solidly anchored fulcrum for vibration of the tube without unduly restricting the flexing of the free end of the tube as required for optimal vibration.

All prior crown and stopper constructions have drawbacks. First, none provide means for lengthening or adjusting the embouchure to crown vibrational length beyond that predetermined by the manufacturer of the headjoint. Second, all prior devices either make ineffectual use of the crown as a fulcrum for the vibrating tube or draw the crown and stopper into a rigid unit that restricts vibration of the tube. All prior devices fall into two general categories as illustrated in FIG. 1 and FIG. 2.

In FIG. 1, the crown is friction-fitted to the inner surface of the headjoint tube with elastic material, a connection that is inadequate to allow the crown to serve as an anchored fulcrum for the vibrating tube. Flutes of the Baroque period make use of this design. Bigio and Symington offer crowns and stoppers of this design for modern concert flutes, utilizing O-rings as elastic material. Fajardo dispenses with the crown entirely in one embodiment while Couesnon and Melfi replace the crown with an acoustic horn to transmit sound from the stopper area to the player. In these three cases there is no crown to act as a fulcrum. Jenner, Sandner, and Fajardo disclose unified crown and stoppers in which the planar face of the crown is not drawn against the free end of the headjoint tube in a manner sufficient for the crown to act as a fulcrum for the vibrating tube.

In FIG. 2, a crown with a uniform planar contact area is drawn firmly against the entire radius of the free end of the headjoint tube by means of a threaded engagement, greatly restricting the vibration of the tube. The crown is firmly coupled to the stopper by means of a solid threaded stem attached to the stopper. Crown, tube, and stopper are thus bound into a rigid unit, further restricting vibration of the headjoint tube. In addition, the outward pressure exerted by the stopper upon the inner surface of the headjoint tube is determined only by the nature of the elastic material used and any pressure exerted upon it. As there is no means to monitor this pressure when installing a traditional stopper, it often greatly exceeds that which is needed to simply create a seal and prevent movement of the stopper. Excessive pressure against the inner surface of the headjoint tube at the stopper further restricts vibration of the headjoint tube.

Modifications to the design of FIG. 2 have been made for several purposes. Rudall and Rose, and Lillicrap disclose mechanisms to more easily control the tuning of the octaves by facilitating the adjustment of the stopper position. Pellerite and Ferron disclose alterations to the stopper face shape to improve the response of certain tones. Lora, Pellerite, Dong, and Wilhelmus disclose alterations to the construction of the stopper and to the choice of elastic material to enhance the weak vibrations that pass from the embouchure area of the air column through the stopper into the area between stopper and crown. Nagahara provides a crown that locks into position on the threaded stem of the stopper rather than against the end of the headjoint tube, eliminating the possibility of the crown acting as a fulcrum for the vibrating tube. None of these modifications address the disadvantages disclosed above and none take into consideration the vibration of the flute tube or the role of the crown as a fulcrum for the vibrating tube.

The invention disclosed herein overcomes each of the disadvantages outlined above and provides additional improvements in the design of headjoint crown assemblies.

SUMMARY

As will become apparent from the following discussion, this invention provides a novel extension unit and crown assembly with components that enable the vibrational length of the vibrational transmission line connecting the embouchure with the crown of the headjoint of an instrument of the flute family to be extended, thereby enhancing the quality and resonance of the sound produced. The novel extension unit and crown assembly are applicable to both new and existing headjoints.

One embodiment utilizes an extension tube folded in upon itself to form the extension unit to be inserted within the chamber existing between the free end of the headjoint tube and the stopper, contacting the headjoint tube by means of a flange attached to the free end of the outer member of the folded extension. A crown is drawn against the free end of the inner member of the folded extension by threaded engagement, thus drawing the folded extension against the free end of the headjoint tube. The vibrational transmission line from embouchure to crown follows the path of the headjoint tube from embouchure to the free end of the headjoint tube where it is extended by passing along first the outer and then the inner member of the folded extension before reaching the crown. The vibrational length between crown and stopper is thus increased by the combined length of the inner and outer extension tubes while the pre-existing lateral length between crown and stopper remains essentially unchanged, thereby preserving the aesthetic appearance of the headjoint.

The new extension unit may be combined with a novel headjoint stopper that provides a flexible coupling with the crown, thereby allowing the headjoint tube to vibrate more freely between crown and stopper. This novel stopper may also be provided with a pressure-regulating spring to limit the outward pressure of the elastic sealing material against the inner surface of the headjoint, ensuring free vibration of the headjoint tube at the stopper.

According to another embodiment, the player can, by manual rotation of the crown, quickly select one of several predetermined vibrational lengths for the extension unit, thus changing the sound and response of the instrument. In this embodiment, the crown is provided with multiple radial contact arms. The outer member of the folded extension is coupled with an intermediary tube or tubes of varying length(s), terminating on their free ends at the plane of the radial contact arms of the crown where the tubes are supplied with a circular sequence of contacts each having a certain surface which is suitable for contact and sliding. The crown is drawn by threaded engagement against contact points at the free end of an individual tube when rotated to any of several specific index positions, thus selecting a vibrational length for the extension unit.

Crown assemblies utilizing the novel extension may be applied to any instrument of the flute family without affecting the operation and aesthetic appearance of the instrument. Student instruments as well as handmade professional instruments will benefit equally from the novel extension. Embodiments with selectable vibrational lengths provide instant adjustments to tone and response hitherto unknown to instruments of the flute family.

There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

These together with other objects of the invention, along with the various features of novelty, which characterize the invention, are pointed out with particularity in the claims annexed to and forming a part of this disclosure. For a better understanding of the invention, its operating advantages, and the specific objects attained by its uses, reference should be made to the accompanying drawings and descriptive matter in which there are illustrated preferred embodiments of the invention.

DRAWINGS

Figures

In the drawings, closely related figures have the same number but different alphabetic suffixes.

FIG. 5C illustrates the free ends of the array of bars of the extension unit of FIG. 5D.

FIG. 5D illustrates a longitudinal sectional view of an extension unit wherein an array of bars has replaced the inner tube of the extension unit of FIG. 5A.

FIG. 5E illustrates a longitudinal sectional view of the extension unit of FIG. 5D permanently attached to a crown to form a unified crown and extension unit.

FIG. 6 illustrates a longitudinal sectional view of a stopper with helical spring coupling between inner and outer stem members.

FIG. 7 illustrates a longitudinal sectional view of a stopper with a curved disc spring applying regulated pressure against an elastic washer and utilizing the helical spring coupling between inner and outer stem members of FIG. 6.

FIG. 8 illustrates a perspective view of a headjoint-facing side of a crown with three equally-spaced radial arms having planar contact surfaces.

FIG. 9A illustrates the free end of the selectable extension unit of FIG. 9B showing three concentric sets of contact tabs for selectable sliding engagement with the crown of FIG. 8.

FIG. 9B illustrates a longitudinal sectional view of a selectable extension unit utilizing a tube folded in upon itself to form an inner and outer tube, and fitted with an additional intermediary tube.

FIG. 9C illustrates the free end of the selectable extension unit of FIG. 9D showing three concentric sets of contact tabs for selectable sliding engagement with the crown of FIG. 8.

FIG. 9D illustrates a longitudinal sectional view of a selectable extension unit utilizing an array of bars, equivalent in function to the extension unit of FIG. 9B.

REFERENCE NUMERALS

Figure 1:
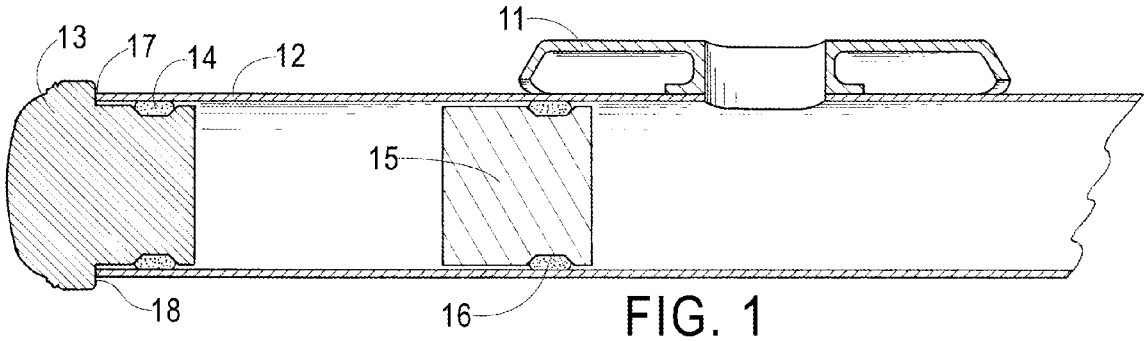
FIG. 1 Prior Art
FIG. 1 illustrates a longitudinal sectional view a conventional crown and stopper utilizing elastic material to hold each in place independently in a flute headjoint.

11 embouchure
12 headjoint tube
13 crown
13A crown
13B crown
13C crown
13D crown
14 elastic material
15 stopper
15A stopper
16 elastic material
17 free end of headjoint tube 12
18 planar contact surface
21 metal disc face plate
21A metal disc face plate
22 elastic material
22A elastic material
22B elastic washer
23 back washer
23A back washer
24 threaded nut
25 externally threaded stem
26 back side of metal disc face plate 21
26A back side of metal disc face plate 21A
27 front side of metal disc face plate 21
28 internally threaded stem
28A internally threaded stem
28B internally threaded stem
29 head
31 extension tube
32 outward-facing flange
32A inward-facing flange
32B outward-facing flange
33 alignment ring
34 externally threaded extension stem
35 internally threaded coupling
41 inner tube
41A outer tube
41B outer tube
42 outer tube
42A inner tube
42B inner tube
43 lower coupling ring
43A lower coupling ring
43B lower coupling ring
51 contact tab
51A contact tab
51B contact tab
51C contact tab
52 bar
61 internally and externally threaded stem
62 externally threaded inner stem
63 tubular housing
63A tubular housing
64 helical spring
65 externally threaded outer stem
66 outer flange
67 inner flange
68 stopper
71 curved disc spring
72 stop
73 stopper
81 radial arm
82 contact surface
91 contact tab
91A contact tab
91B contact tab
91C contact tab
92 upper coupling ring
93 selectable extension unit
94 intermediary tube
95 bar
96 bar
97 bar
98 selectable extension unit

101 stamped numeral "1"
102 stamped numeral "2"
103 stamped numeral "3"
104 index notch
105 slit
106 slit
107 slit

DETAILED DESCRIPTION

In the following detailed description, reference is made to the accompanying drawings that form a part hereof, and in which are shown, by way of illustration, specific embodiments that may be practiced. These embodiments are described in sufficient detail to enable those skilled in the art to practice the embodiments, and it is to be understood that other embodiments may be utilized, and that changes may be made without departing from the scope of the embodiments. The following detailed description is, therefore, not to be taken in a limiting sense.

This invention relates to novel extension units and crown assemblies utilizing the novel extension units for headjoints of musical instruments of the flute family. Although the term "flute" is used herein, it is to be understood that this term refers generally to musical instruments of the flute family, such instruments including concert flutes, alto flutes, and piccolos.

Crown assemblies incorporating the new extension units provide greatly increased depth and resonance to the flute sound and enhance the flutist's ability to drive and control the vibration of the flute tube. Crown assemblies containing particular embodiments of the new extension unit provide freer vibration of the headjoint tube, significantly augmenting the benefits of the novel extension unit. In addition, crown assemblies containing particular embodiments provide means for quickly changing the tone and response characteristics of the instrument by means of a simple rotation of the crown. Such significant changes in tone and response of the headjoint were previously known only by replacing the entire headjoint with one of differing construction, a costly and an impractical option for most performance situations. The benefits of the novel crown assembly are obtained without sacrificing the traditional aesthetic appearance of the headjoint to which it is applied. Embodiments of this invention are applicable to both new and existing headjoints of any material for musical instruments of the flute family.

COMMON TERMS

Traditional crown assemblies are composed of two or more components described in detail below. As used herein, the term "crown assembly" refers to two or more members that form terminations for the free end of the headjoint tube and for the air column within. Traditional crown assemblies comprise a sealed stop for the air column, herein referred to as a "stopper", and a covering for the free end of the headjoint tube, herein referred to as a "crown". As used herein, the term "headjoint" refers to a detachable section of an instrument of the flute family, comprising a headjoint tube and a mouthpiece, herein referred to as an "embouchure". The headjoint tube may be constructed of wood, rubber, plastic, carbon fiber, brass, silver, nickel-silver, gold, platinum, or combinations thereof. As used herein, the term "elastic material" refers to deformable materials such as rubber, O-rings, neoprene, cork, or any similar material. Cork is traditionally utilized on stoppers as an elastic material to expand outwardly into tight-sealing and firm-positioning engagement with the inner surface of the headjoint tube, though rubber was used as early as 1895 and O-rings are not uncommon today.

Two general types of traditional crown assemblies may be distinguished: those with a crown drawn against the free end of the headjoint tube through a coupling to the stopper and those with an independent crown coupled to the inner surface of the headjoint tube by elastic material. The concentrated mass of the crown acts as an anchored fulcrum at the endpoint of the vibrating flute tube when drawn into direct contact with the free end of the headjoint tube, but its function is essentially reduced to that of an ornament when loosely coupled to the inner surface of the headjoint tube by elastic material.

The term "vibrational transmission line" as utilized herein refers to a connected path of vibrational material, such as thin metal tubing, to transmit vibrations from one point to another along a flute tube and crown assembly. The term "vibrational length" refers to the distance travelled from one specified point to another by vibrations along a vibrational transmission line. An "extension unit" is a section of vibrational transmission line interposed between the free end of a headjoint tube and a crown to increase the total vibrational length between the embouchure and the crown of a flute. An extension unit may form part of a complete crown assembly including a crown and a stopper. A "selectable extension unit" offers a choice of multiple vibrational lengths when utilized in an appropriate crown assembly. The term "index position" refers to specific points of alignment between the crown and the selectable extension unit that produce specific vibrational lengths for a crown assembly utilizing such a unit. Index positions may be identified by a series of numbers or other markings on the perimeter of the crown and a corresponding index notch on the perimeter of the selectable extension unit flange.

A more detailed description of the invention follows and refers to the appended drawings.

Figure 2:
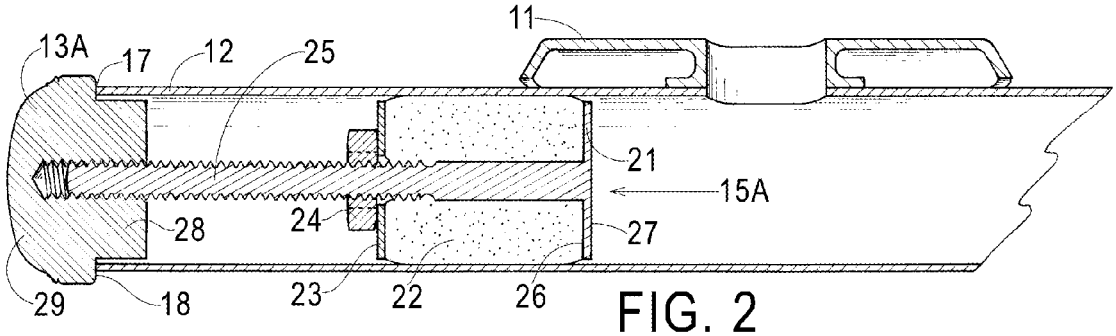
FIG. 2 Prior Art
FIG. 2 illustrates a longitudinal sectional view of a conventional crown and stopper utilizing elastic material to hold the stopper in place and an externally threaded stem to draw the crown against the free end of the headjoint tube.

FIG. 1 and FIG. 2—Prior Art Crown Assemblies

FIG. 1 shows a traditional crown 13 and stopper 15 mounted by means of elastic materials 14 and 16 in a headjoint comprising an embouchure 11 and a headjoint tube 12. The elastic materials 14 and 16 may be cork, waxed string, rubber O-rings, or other suitable material. Both crown 13 and stopper 15 may be constructed of wood, plastic, or metal. The stopper may be constructed entirely of elastic material such as cork and may be faced with a metal disc on the side facing the embouchure. The crown is coupled to the headjoint tube by elastic material 14 only. The planar contact surface 18 of the crown is not drawn against the free end 17 of the headjoint tube. The crown may be constructed as a solid piece or hollowed out as desired to reduce weight.

FIG. 2 shows a traditional crown 13A and stopper 15A coupled by an externally threaded stem 25. The stopper is installed in a headjoint comprising an embouchure 11 and a headjoint tube 12. Stopper 15A includes an externally threaded stem 25 that is integral with and concentric to metal disc face plate 21, and extending outwardly from the back side 26 of face plate 21. Stopper 15A utilizes an elastic material 22 such as cork or rubber which is compressed between face plate 21 and a back washer 23 when an internally threaded nut 24 is received on externally threaded stem 25 and drawn against washer 23. The washer may be combined with the nut to form an internally threaded washer. Crown 13A comprises a head 29 and an internally threaded stem 28 which may or may not extend beyond a planar contact surface 18. The head may be constructed as a solid piece or hollowed out as desired to reduce weight. The crown is coupled to the headjoint tube 12 when the internally threaded stem 28 is received on externally threaded stem 25 and the planar contact surface 18 of the crown is drawn against the free end 17 of headjoint tube 12. The vibrational length of the vibrational transmission line formed by headjoint tube 12 between the center of the embouchure and the surface 18 of the crown is equal to the lateral distance from the center of the embouchure to the free end 17 of the headjoint tube.

The lateral distance from the center of embouchure 11 to the free end 17 of the headjoint tube varies by manufacturer but is generally 66 to 68 millimeters on concert flutes. The lateral distance from the center of the embouchure to the front side 27 of face plate 21 can be adjusted by the player but is generally between 17 and 18 millimeters on concert flutes for correct tuning of the octaves. This leaves a lateral distance of 48 to 51 millimeters between the front side 27 of face plate 21 and the free end 17 of the headjoint tube.

Figure 3:
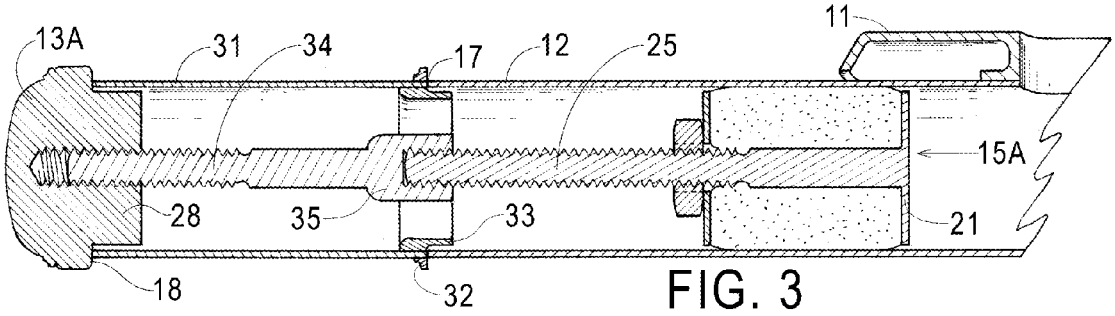
FIG. 3 illustrates a longitudinal sectional view of an extension unit utilizing an extension tube fitted to the free end of a headjoint tube and held in place by a traditional crown and stopper of the type shown in FIG. 2.

FIG. 3—Basic Extension Unit

Referring to FIG. 3, there is illustrated an embodiment of the invention unit installed on a headjoint comprising an embouchure 11 and a headjoint tube 12 in which a crown 13A and a stopper 15A are identical to that of FIG. 2 with an extension unit interposed between the free end 17 of headjoint tube 12 and the planar contact surface 18 of crown 13A. The extension unit comprises an extension tube 31, an outward-facing flange 32, and an alignment ring 33. Extension tube 31 may be constructed of thin brass, silver, gold, or other vibrant material. Although the extension tube may be made to any length, a length range of 10 to 100 millimeters is contemplated. Externally threaded stem 25 is affixed to a metal disc face plate 21 and coupled to externally threaded extension stem 34 by means of an internally threaded coupling 35. The planar contact surface 18 of the crown is drawn against the free end of the extension tube, causing flange 32 affixed to the opposite end of the extension tube to be drawn against the free end 17 of the headjoint tube when the internally threaded stem 28 of the crown is received on externally threaded extension stem 34. In this way, a vibrational transmission line between the embouchure and the crown is completed and the vibrational length of this transmission line is greater than that of the traditional assembly of FIG. 2 by the length of extension tube 31.

Figure 4:
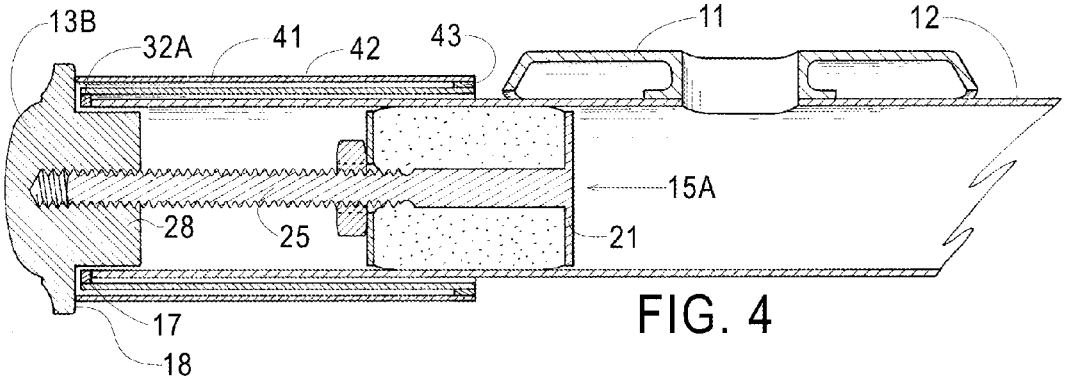
FIG. 4 illustrates a longitudinal sectional view of an extension unit utilizing a tube folded in upon itself to form an inner and outer tube and held in place exterior to the headjoint tube by a traditional crown and stopper of the type shown in FIG. 2.

FIG. 4—External Folded Extension Unit

FIG. 4 illustrates an embodiment of the invention installed on a headjoint comprising an embouchure 11 and a headjoint tube 12 in which a crown 13B and a stopper 15A are essentially the same as that of FIG. 2 and FIG. 3, and in which the extension tube 31 of FIG. 3 has been folded in upon itself to form a coaxial inner tube 41 and outer tube 42, coupled by a lower coupling ring 43 and fitted with an inward-facing flange 32A attached to the free end of inner tube 41. This folded extension unit is so arranged as to be coaxial to and exterior to headjoint tube 12 in the area between the embouchure and the crown. The planar contact surface 18 of the crown is drawn against the free end of outer tube 42 causing inward-facing flange 32A to be drawn against the free end 17 of the headjoint tube when the internally threaded stem 28 of the crown is received on an externally threaded stem 25 affixed to the metal disc face plate 21. In this way, a vibrational transmission line between the embouchure and the crown is completed and the vibrational length of this transmission line is greater than that of the traditional assembly of FIG. 2 by the sum of the lengths of outer tube 42 and inner tube 41. The lateral length between embouchure 11 and crown 13B remains essentially unchanged from that of a similar headjoint without the extension unit installed.

FIG. 5A Through 5E—Internal Folded Extension Units

Figure 5A:
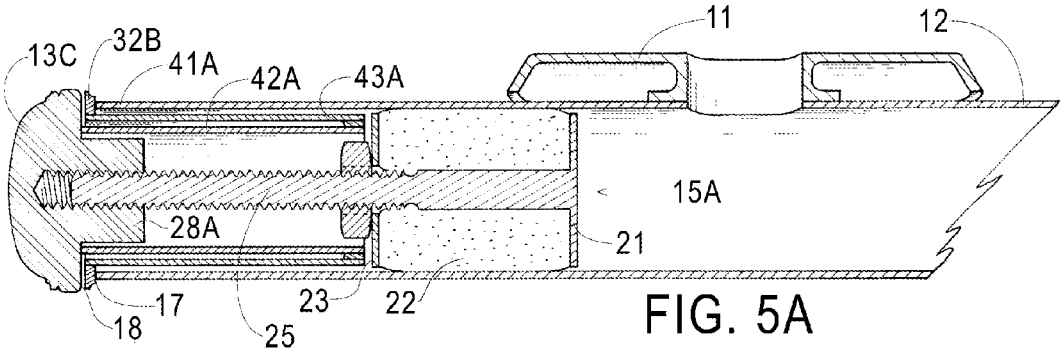
FIG. 5A illustrates a longitudinal sectional view of an extension unit utilizing a tube folded in upon itself to form an inner and outer tube and held in place interior to the headjoint tube by a traditional crown and stopper of the type shown in FIG. 2.

FIG. 5A illustrates a similar embodiment of the invention installed on a headjoint comprising an embouchure 11 and a headjoint tube 12 in which a crown 13C and a stopper 15A are essentially the same as that of FIG. 2 and FIG. 3, and in which the folded extension unit of FIG. 4 is so altered as to be placed within the cavity formed at the free end of headjoint tube 12. In this embodiment, an outer tube 41A is coupled to a coaxial inner tube 42A with a lower coupling ring 43A and fitted with an outward-facing flange 32B attached to the free end of outer tube 41A. This folded extension unit is so arranged as to be coaxial to and interior to headjoint tube 12. The planar contact surface 18 of the crown is drawn against the free end of inner tube 42A causing outward-facing flange 32B to be drawn against the free end 17 of the headjoint tube when the internally threaded stem 28A of the crown is received on an externally threaded stem 25 affixed to the metal disc face plate 21. In this way, a vibrational transmission line between the embouchure and the crown is completed and the vibrational length of this transmission line is greater than that of the traditional assembly of FIG. 2 by the sum of the lengths of outer tube 41A and inner tube 42A. The lateral length between embouchure 11 and crown 13C remains essentially unchanged from that of a similar headjoint without the extension unit installed, thus maintaining the traditional aesthetic appearance of the headjoint.

In this embodiment, the length of outer tube 41A is limited by the depth of the cavity formed between the back end of the stopper assembly at washer 23 and the free end 17 of headjoint tube 12. Decreasing the length of elastic material 22 will increase this length. Cork is the most common elastic material used in traditional stoppers and the length of cork utilized is generally about 30 millimeters. The length of this cork cannot be reduced below about 20 millimeters without risking slippage of the cork against the inner surface of headjoint tube 12 when the crown is received upon stem 25 and drawn against the extension unit and headjoint tube. The large space occupied by a stopper of traditional construction limits the length of outer tube 41A to about 25 millimeters. The length of elastic material 22 can be substantially reduced by replacing the cork with a thin neoprene washer or an O-ring assembly, allowing the length of outer tube 41A to increase to about 40 millimeters.

Figure 5B:
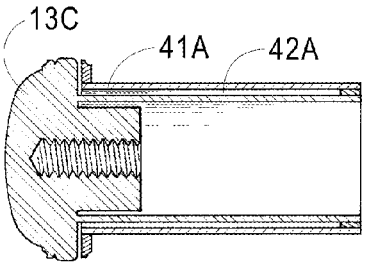
FIG. 5B illustrates a longitudinal sectional view of the extension unit of FIG. 5A permanently attached to a crown to form a unified crown and extension unit.

FIG. 5B illustrates the extension unit of FIG. 5A constructed with crown 13C permanently attached to the free end of inner tube 42A, forming a unified crown and extension unit.

One or both of the pair of coaxial inner and outer tubes 42A and 41A of the embodiment of FIG. 5A may be replaced with an array of folded lateral rods or bars such as illustrated in the embodiment of FIG. 5C and FIG. 5D where inner tube 42A of FIG. 5A is replaced with an array of bars 52 terminating on their free ends in contact tabs 51. The contact tabs are drawn against the planar contact surface 18 of crown 13C of FIG. 5A when the internally threaded stem 28A of the crown is received on externally threaded stem 25 affixed to metal disc face plate 21. A vibrational transmission line is thus completed between embouchure and crown and the vibrational length of this transmission line is greater than that of the traditional assembly of FIG. 2 by the sum of the lengths of outer tube 41A and bars 52 of FIG. 5D. The lateral length between embouchure 11 and crown 13C of FIG. 5A remains essentially unchanged from that of a similar headjoint without the extension unit installed, thus maintaining the traditional aesthetic appearance of the headjoint.

FIG. 5E illustrates the extension unit of FIG. 5C and FIG. 5D with crown 13C permanently attached to the free ends of bars 52, forming a unified crown and extension unit.

FIG. 6 and FIG. 7—Stoppers with Helical Spring Coupling

FIG. 6 shows a stopper 68 in which a section of the solid externally threaded stem 25 of FIG. 2 is replaced with a helical spring 64 which is friction fitted to an externally threaded inner stem 62 on one end and an externally threaded outer stem 65 on the other end, forming a flexible coupling between a metal disc face plate 21A and a crown, thereby allowing a headjoint tube to vibrate more freely in the area between crown and stopper. Stopper 68 utilizes an externally threaded inner stem 62 installed on an internally and externally threaded stem 61 that is affixed to the back side 26A of metal disc face plate 21A. Helical spring 64 of the stopper is encased in an internally threaded tubular housing 63 that is surrounded by an elastic material 22A such as cork, neoprene, or an O-ring assembly. The elastic material is held between face plate 21A and an outer flange 66 affixed to internally threaded tubular housing 63. Helical spring 64 is extended when the internally threaded stem of the crown is received on externally threaded outer stem 65 of stopper 68 and the crown is drawn against the free end of the headjoint tube or the extension unit installed in the free end of the headjoint tube. Extension of helical spring 64 is limited by inner flange 67 affixed to the free end of tubular housing 63. The pressure of the crown against the headjoint tube or extension unit may be precisely adjusted when the helical spring is gradually extended while the crown is gradually rotated several turns to arrive at the desired spring tension. Such precise control over the pressure of the crown against the headjoint tube or extension unit is impossible with stoppers utilizing a solid stem, as the pressure will increase from zero to an undesirably high amount within a few degrees of rotation of the crown.

FIG. 7 illustrates a similar stopper 73 in which the pressure exerted by an elastic washer 22B against the inner surface of a headjoint tube is regulated by a curved disc spring 71 to ensure free vibration of the headjoint tube in the area of the stopper. Inasmuch as the elastic washer is a rubber or rubber compound, although similar material may be suitable, the overall volume remains virtually the same regardless of the shape it assumes. Consequently, a decrease in thickness of elastic washer 22B causes an increase in perimeter length of the washer. This increase in perimeter length causes the outside diameter dimension of the elastic washer to increase and to expand outwardly into tight-sealing and firm-positioning engagement with the inner surface of the headjoint tube. With a traditional stopper, such as that illustrated in FIG. 2, the more nut 24 is tightened against washer 23, the greater the compression of elastic material 22 and the greater the outside diameter dimension growth of material 22, increasing the outward pressure against the headjoint tube. A similar situation occurs in stopper 68 of FIG. 6 when outer flange 66 is tightened against elastic material 22A. But in the double-spring stopper 73 of FIG. 7, the internal threads of tubular housing 63A stop at 72, limiting the compression of curved disc spring 71 at a predetermined point. Spring 71 will thereby apply a constant predetermined pressure against back washer 23A that will cause a predetermined compression of elastic washer 22B. Spring 71 will thus maintain a constant predetermined outward pressure on the inner surface of the headjoint tube at elastic washer 22B regardless of minor variations in diameter of the headjoint tube due to variations in manufacture.

FIG. 8—Crown with Radial Arms

FIG. 8 shows a crown 13D with three equally-spaced radial arms 81 formed with planar contact surfaces 82 and an internally threaded stem 28B. These surfaces 82 will make contact with the free end of a headjoint tube or extension unit when internally threaded stem 28B is received on an externally threaded stem such as stem 25 of FIG. 5A. Surfaces 82 contact only a small percentage of the total area of the free end of a headjoint tube or extension unit, leaving the remaining area free to flex and vibrate. This stands in contrast to the traditional crowns of FIG. 2 through FIG. 5A where uniform contact is made along the entire circumference of the free end of a headjoint tube or extension unit, preventing any flexing of the tube the point of contact. Crown 13D may replace a traditional crown in any of the embodiments shown in FIG. 2 through FIG. 5A.

FIG. 9A Through 9D—Selectable Extension Units

FIG. 9A and FIG. 9B illustrate a further embodiment in which the folded extension unit of FIG. 5A is given an additional intermediary tube 94 to form a selectable extension unit 93 that allows a choice of extension lengths when combined with a crown of the type shown in FIG. 8 and a stopper of the types shown in FIG. 6 or FIG. 7. In the selectable extension unit 93, intermediary tube 94 is coupled to an outer tube 41B by an upper coupling ring 92. Inner tube 42B is reduced in diameter to make room for tube 94 and coupled to outer tube 41B by a thickened lower coupling ring 43B. The three tubes, 41B, 94, and 42B are so arranged as to be coaxial with and internal to a headjoint tube when a selectable extension unit 93 is installed on a headjoint. FIG. 9A illustrates the free ends of the three tubes, 41B, 94, and 42B, each of which has a series of three equally-spaced contact tabs 91 forming a total of nine contact tabs lying in the same plane. Three equally-spaced tabs 91A are affixed to the free end of tube 41B, three equally-spaced tabs 91B are affixed to the free end of tube 94, and three equally-spaced tabs 91C are affixed to the free end of tube 42B. These tabs are angularly staggered, disposing each series symmetrically with respect to the other two series and resulting in a contact tab of one series lying in line with spaces between adjacent contact tabs in the other two series. Because the three series of contact tabs are disposed along concentric circles of differing radii, the radial arms 81 of crown 13D of FIG. 8 will make tripartite contact with three contact tabs of an individual tube when the crown is rotated to each of three predetermined index positions. Because the angular length of the contact surfaces 82 of radial arms 81 is greater than the angular length between contact tabs 91, contact surfaces 82 will remain in continuous sliding contact with three or more contact tabs 91 when the crown is rotated from one index position to the next.

One or more tubes 41B, 94, and 42B of selectable extension unit 93 may be replaced with an array of folded lateral rods or bars such as in selectable extension unit 98, illustrated in FIG. 9C and FIG. 9D. In this embodiment, tube 41B has been replaced with bars 95, tube 94 has been replaced with bars 96, and tube 42B has been replaced with bars 97. FIG. 9D illustrates the length of the folded lateral bars of selectable extension unit 98.

FIG. 9C illustrates the free ends of the folded lateral bars of selectable extension unit 98. Each set of three bars, 95, 96, and 97, end in equally-spaced contact tabs 51 forming a total of nine contact tabs lying in the same plane. Three equally-spaced contact tabs 51A form the ends of bars 95, three equally-spaced contact tabs 51B form the ends of bars 96, and three equally-spaced contact tabs 51C form the ends of bars 97. These contact tabs are angularly staggered, disposing each series symmetrically with respect to the other two series and resulting in a contact tab of one series lying in line with spaces between adjacent contact tabs in the other two series. The radial arms 81 of crown 13D of FIG. 8 will make tripartite contact with three contact tabs of an individual set of bars 95, 96, or 97, when the crown is rotated to each of three predetermined index positions. Because the angular length of the contact surfaces 82 of radial arms 81 is greater than the angular length between contact tabs 51, contact surfaces 82 will remain in continuous sliding contact with three or more contact tabs 51 when the crown is rotated from one index position to the next.

Figure 10:
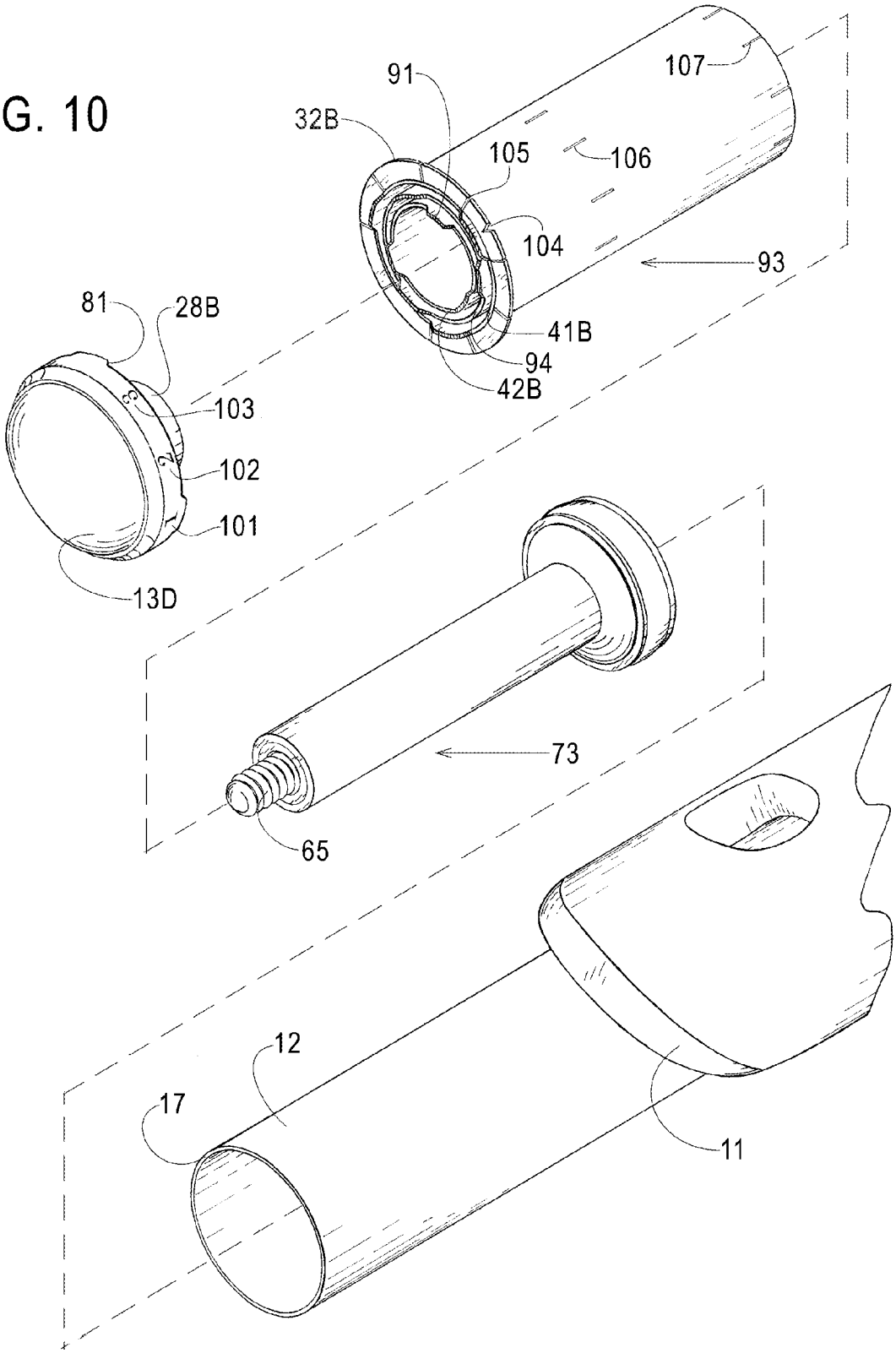
FIG. 10 illustrates an exploded perspective view of a crown assembly utilizing the crown of FIG. 8 with the selectable extension unit of FIG. 9B and the stopper of FIG. 7, installed on a headjoint.

FIG. 10—Crown Assembly with Selectable Vibrational Lengths

FIG. 10 is an exploded view of an embodiment of a complete crown assembly, comprising crown 13D of FIG. 8, selectable extension unit 93 of FIG. 9B, and double-spring stopper 73 of FIG. 7. The contact surfaces of radial arms 81 of the crown are drawn against contact tabs 91 of the extension unit when internally threaded stem 28B is received on externally threaded outer stem 65. An essentially constant pressure is maintained between the radial arms and the contact tabs by helical spring 64 (FIG. 7) while radial arms 81 are rotated to each of three index positions, the variation in extension of the helical spring due to rotation of stem 28B on stem 65 being negligible. The index positions are indicated by the alignment of stamped numerals 101, 102, and 103 on the perimeter of crown 13D with index notch 104 on the perimeter of flange 32B of the selectable extension unit. Because the contact area of flange 32B against the free end 17 of headjoint tube 12 is much greater than the sliding contact area of radial arms 81 against tabs 91, the selectable extension unit will not rotate with respect to the headjoint tube when the crown is rotated from one index position to the next.

The vibrational length of the vibrational transmission line between embouchure 11 and crown 13D is increased by three predetermined lengths from that of a similar headjoint without the selectable extension unit installed. When crown 13D is rotated with respect to flange 32B such that the number "1" at 101 is aligned with index notch 104 on the flange, radial arms 81 of crown 13D make tripartite contact with contact tabs 91A (FIG. 9A) at the free end of outer tube 41B. These contact tabs are closely linked to flange 32B, which is drawn against the free end 17 of the headjoint tube. Therefore, the length of the vibrational transmission line between radial arms 81 and free end 17 is a distance of only 2 to 5 millimeters. This small extension to the overall vibrational transmission line from embouchure to crown will result in almost no difference in tone and response from that of an instrument without extension unit, utilizing a similar crown and stopper. When crown 13D is rotated with respect to flange 32B such that the number "2" at 102 is aligned with index notch 104 on the flange, the radial arms 81 of crown 13D make tripartite contact with contact tabs 91B (FIG. 9A) at the free end of intermediary tube 94. In this case, the path of the vibrational transmission line between radial arms 81 and free end 17, as formed by extension unit 93, follows the length of intermediary tube 94 to upper coupling ring 92 and returns an equal distance along outer tube 41B, arriving at flange 32B (FIG. 9B). Therefore, the total extension in index position "2" is equal to twice the length of tube 94. When crown 13D is rotated with respect to flange 32B such that the number "3" at 103 is aligned with index notch 104 on the flange, the radial arms 81 of crown 13D make tripartite contact with contact tabs 91C (FIG. 9A) at the free end of inner extension tube 42B. In this case, the path of the vibrational transmission line between radial arms 81 and free end 17, as formed by extension unit 93, follows the length of inner tube 42B to lower coupling ring 43B and returns an equal distance along outer tube 41B, arriving at flange 32B (FIG. 9B). Therefore, the total extension in index position "3" is equal to twice the length of tube 41B.

If tube 94 (FIG. 9B) is given a length of 15 millimeters and tube 41B given a length of 40 millimeters, then the extensions to the vibrational lengths will be about 3 millimeters in index position "1", 30 millimeters in index position "2", and 80 millimeters in index position "3". This gives the player the ability to select between three very different tone and response settings with a simple rotation of the crown to any of the three index positions. In FIG. 10, the lateral length between embouchure 11 and crown 13D remains essentially unchanged from that of a similar headjoint without selectable extension unit 93 installed, thus maintaining the traditional aesthetic appearance of the headjoint.

The selectable extension unit 98 of FIG. 9D may replace the selectable extension unit 93 of FIG. 9B in the embodiment of FIG. 10. Contact tabs MA at the ends of bars 95 of extension unit 98 are closely linked to flange 32B (FIGS. 9C and 9D). The portion of bars 95 extending behind flange 32B does not contribute to the vibrational transmission line. Therefore, the length of the vibrational transmission line extension between radial arms 81 and free end 17 (FIG. 10) is a distance of only 2 to 5 millimeters when index position "1" is selected, just as with selectable extension unit 93. If the lateral length from contact tabs 51 to the fold of bars 96 and 97 of unit 98 (FIG. 9D) are made equal to the lengths of unit 93's tubes 94 and 41B respectively (FIG. 9B) then the extension to the vibrational transmission line from embouchure to crown of the extension unit 98 will be found to be equal to that of extension unit 93 when crown 13D is rotated to index positions "2" and "3" as well when unit 98 replaces unit 93 in the embodiment of FIG. 10. The lateral length between embouchure 11 and crown 13D remains essentially unchanged from that of a similar headjoint without selectable extension unit 98 installed, thus maintaining the traditional aesthetic appearance of the headjoint.

Flanges and coupling rings such as flange 32B and rings 43B and 92 (FIG. 9B) create points of increased thickness and rigidity. Excess rigidity can dampen vibrations passing through these points. This rigidity can be eliminated while maintaining vibrational coupling by cutting slits 105, 106, and 107 in these flanges and rings as illustrated in FIG. 10. The number of slits contemplated for each flange or ring can range from about three to as many as 30. Nine slits are employed in the embodiment of FIG. 10. Similar slits may also be introduced to eliminate excess rigidity at flanges and rings on all other embodiments of extension units.

Design Considerations

The crown assemblies with selectable extension units utilize crowns with radial arms and stoppers with helical spring coupling. These crowns may be produced as a single casting. Optimal pressure of the crown against the selectable extension unit is between about 1 and 4 pounds. A helical spring of about 1 inch length with a rate of 15 to 20 pounds per inch will generate a pull of about 2.3 to 3.1 pounds when a crown is drawn down 5 turns on a stem with 32 pitch threads, resulting in a 0.156" extension of the helical spring. A stop may be so placed as to limit spring extension at 0.2" or just over 6 turns of the crown. If a stopper utilizing a neoprene washer compressed by a curved disc spring is employed, a soft neoprene with Shore durometer scale A rating of about 30 will be most effective and will make sufficiently tight-sealing and firm-positioning engagement with the inner surface of the headjoint tube without creating excess tension when a curved disc spring of about 8 pound load rating is utilized.

Placed in close proximity to the embouchure, the most sensitive point on the instrument, the specific vibrational characteristics of the extension unit have a significant impact on the sound of the instrument. An extension unit utilizing stock brass tubes of about 0.009" to 0.014" wall thickness will produce effective results while hard drawn sterling silver tubes of about 0.009" to 0.012" wall thickness will be more effective and will be smoother in overall tonal quality. A combination of a hard drawn sterling silver outer tube and a stock brass inner tube will produce nearly the same result at a reduced cost. The best results can be obtained with extensively hand-worked and hard drawn sterling silver tubes of 0.009" to 0.012" wall thickness. Such tubes provide a greatly increased level of warmth and homogeneity to the instrument, aspects which will be particularly noticeable on high-grade student-level instruments that may be mechanically sound but lacking in tonal quality and refinement. Sterling silver tubes of this quality are, however, labor intensive and costly to produce. Tubes of gold may also be used for those players who prefer the exceptional warmth and clarity of a gold flute sound. The selectable feature of certain embodiments offers the possibility of not only changing vibrational transmission line lengths but also selecting between silver, gold, platinum, and other materials for portions of the vibrational transmission line. The individual needs of a wide range of performers may be met through the appropriate choice of extension unit lengths and materials.

The new crown assemblies having a selectable extension unit not only are more vibrant in the area of the crown and stopper, thus increasing the depth and resonance of the flute, but also provide the musician with a simple and quick means of changing the tone and response of their instrument. As a result, the musician has a significantly improved instrument with a heretofore-unknown means for adjusting the instrument as needed for a particular performance environment.

While the invention has been described in detail above with reference to specific embodiments, it will be understood that modifications and alterations in embodiments disclosed may be made by those practiced in the art without departing from the spirit and scope of the invention. All such modifications and alterations are intended to be covered. In addition, all publications cited herein are indicative of the level of skill in the art and are hereby incorporated by reference in their entirety as if each had been individually incorporated by reference and fully set forth.

I claim:

1. An extension unit for the headjoint of an instrument of the flute family, said headjoint comprising an embouchure, a crown, a stopper, and a headjoint tube, and said extension unit comprising:

(a) a tube of vibrant material, similar in radius to the free end of said headjoint tube;

(b) said tube interposed between the free end of said headjoint tube and said crown, and coaxial to said headjoint tube;

(c) said tube having a lateral length from about 5 millimeters to about 100 millimeters; and (d) said crown drawn against said extension unit and said extension unit drawn against the free end of said headjoint tube when said crown is received on a threaded stem attached to said stopper;

whereby the vibrational length from said embouchure to said crown is extended by the vibrational length of said extension unit.

2. The extension unit according to claim 1, wherein said tube is folded in upon itself comprising:

(a) a pair of coaxial inner and outer tubes joined by a lower coupling ring;

(b) the free end of the inner tube fitted with an inward-facing flange;

(c) said pair of coaxial inner and outer tubes interposed between said free end of said headjoint tube and said crown, and adapted to be positioned coaxial to and exterior to said headjoint tube;

(d) said pair of coaxial inner and outer tubes having a lateral length from about 5 millimeters to about 45 millimeters; and (e) said inward-facing flange contacting said free end of said headjoint tube, and said crown contacting the free end of the outer tube when said crown is received on said threaded stem attached to said stopper;

whereby said vibrational length from said embouchure to said crown is extended by the vibrational length of the combined inner and outer tubes, and the lateral length from said embouchure to said crown is essentially the same as that of said headjoint without said extension unit installed.

3. The extension unit according to claim 1, wherein said tube is folded in upon itself comprising:

(a) a pair of coaxial inner and outer tubes joined by a lower coupling ring;

(b) the free end of the outer tube fitted with an outward-facing flange;

(c) said pair of coaxial inner and outer tubes interposed between said free end of said headjoint tube and said crown, and adapted to be positioned coaxial to and interior to said headjoint tube;

(d) said pair of coaxial inner and outer tubes having a lateral length from about 5 millimeters to about 45 millimeters; and (e) said outward-facing flange contacting said free end of said headjoint tube, and said crown contacting the free end of the inner tube when said crown is received on said threaded stem attached to said stopper;

whereby said vibrational length from said embouchure to said crown is extended by the vibrational length of the combined inner and outer tubes, and the lateral length from said embouchure to said crown is essentially the same as that of said headjoint without said extension unit installed.

4. The extension unit according to claim 3, wherein one or both of said pair of coaxial inner and outer tubes are replaced with an array of folded lateral rods or bars.

5. The extension unit according to claim 3, wherein said free end of said inner tube is permanently affixed to said crown such that said crown and said extension unit form a unified member.

6. The extension unit according to claim 5, wherein one or both of said pair of coaxial inner and outer tubes are replaced with an array of folded lateral rods or bars.

7. A crown assembly for the headjoint of an instrument of the flute family, said headjoint comprising an embouchure and a headjoint tube, said crown assembly comprising:

(a) a crown fitted with an internally threaded stem;

(b) a stopper fitted with an externally threaded stem affixed to the back side of a metal disc face plate; and (c) an extension unit comprising:

(i) a pair of coaxial inner and outer tubes joined by a lower coupling ring;

(ii) the free end of the outer tube fitted with an outward-facing flange;

(iii) said pair of coaxial inner and outer tubes interposed between the free end of said headjoint tube and said crown, and adapted to be positioned coaxial to and interior to said headjoint tube;

(iv) said pair of coaxial inner and outer tubes having a lateral length from about 5 millimeters to about 45 millimeters; and (v) said outward-facing flange contacting said free end of said headjoint tube, and said crown contacting the free end of the inner tube when said crown is received on said externally threaded stem attached to said stopper;

whereby the vibrational length from said embouchure to said crown is extended by the vibrational length of the combined inner and outer tubes, and the lateral length from said embouchure to said crown is essentially the same as that of said headjoint without said extension unit installed.

8. The crown assembly according to claim 7, wherein one or both of said pair of coaxial inner and outer tubes are replaced with an array of folded lateral rods or bars.

9. The crown assembly according to claim 7, wherein said crown has three planar contact surfaces on equally-spaced radial arms.

10. The crown assembly according to claim 7, wherein said stopper comprises:

(a) said metal disc face plate;

(b) an internally and externally threaded stem affixed to said back side of said metal disc face plate;

(c) an externally threaded inner stem received on said internally and externally threaded stem;

(d) a helical spring friction fitted to the free end of said externally threaded inner stem;

(e) an externally threaded outer stem friction fitted to the free end of said helical spring;

(f) a tubular housing with internal threads, surrounding said externally threaded stems and said helical spring, and received on said internally and externally threaded stem affixed to said metal disc face plate; and (g) an elastic material such as cork surrounding said tubular housing;

whereby said helical spring forms a flexible coupling between said crown and said stopper, allowing free vibration of said headjoint tube between said crown and said stopper.

11. The crown assembly according to claim 10, wherein one or both of said pair of coaxial inner and outer tubes are replaced with an array of folded lateral rods or bars.

12. The crown assembly according to claim 10, wherein said crown has three planar contact surfaces on equally-spaced radial arms.

13. The crown assembly according to claim 12, wherein said extension unit comprises;

(a) said pair of coaxial inner and outer tubes joined by said lower coupling ring;

(b) said free end of said outer tube fitted with said outward-facing flange;

(c) said pair of coaxial inner and outer tubes interposed between said free end of said headjoint tube and said crown, and adapted to be positioned coaxial to and interior to said headjoint tube;

(d) an intermediary tube of shorter length than said pair of coaxial inner and outer tubes placed coaxial to and between said pair of coaxial inner and outer tubes, joined at the end facing said lower coupling ring to said outer tube by an upper coupling ring;

(e) a series of three equally-spaced contact tabs fitted to the free end of each of the three tubes, forming a total of nine contact tabs;

(f) said nine contact tabs arranged in three concentric series in the same plane, each series angularly spaced with respect to the other two, resulting in a contact tab of one series lying in line with spaces between adjacent contact tabs in the other two series;

(g) said three planar contact surfaces of said crown so adapted to make tripartite contact with said series of three equally-spaced contact tabs fitted to a selected individual tube of said three tubes when said crown is rotated to each of three predetermined index positions; and (h) said tripartite contact formed when said internally threaded stem of said crown is received on said externally threaded outer stem of said stopper, drawing said outward-facing flange on said outer tube against the free end of said headjoint tube;

whereby the vibrational length of said extension unit can be varied between three predetermined lengths as said crown is rotated to each of said three predetermined index positions; and whereby said vibrational length from said embouchure to said crown is extended by said vibrational length of said extension unit, and said lateral length from said embouchure to said crown is essentially the same as that of said headjoint without said extension unit installed.

14. The extension unit according to claim 13, wherein one or more of said three tubes is replaced with an array of folded lateral rods or bars.

15. The crown assembly according to claim 7, wherein said headjoint stopper comprises:

(a) said metal disc face plate;

(b) an internally and externally threaded stem affixed to said back side of said metal disc face plate;

(c) an externally threaded inner stem received on said internally and externally threaded stem;

(d) a helical spring friction fitted to the free end of said externally threaded inner stem;

(e) an externally threaded outer stem friction fitted to the free end of said helical spring;

(f) a tubular housing with internal threads surrounding said externally threaded stems and said helical spring, and received on said internally and externally threaded stem affixed to said metal disc face plate;

(g) an elastic washer of neoprene or similar material concentric to said internally and externally threaded stem and placed between said metal disc face plate and a back washer; and (h) a curved disc spring concentric to said internally and externally threaded stem, placed between said back washer and said tubular housing;

whereby said helical spring forms a flexible coupling between said crown and said stopper, allowing free vibration of said headjoint tube between said crown and said stopper; and said curved disc spring applies a constant predetermined pressure to said elastic washer, compressing said elastic washer which in turn applies a constant predetermined outward pressure to the inner surface of said headjoint tube.

16. The crown assembly according to claim 15, wherein one or both of said pair of coaxial inner and outer tubes are replaced with an array of folded lateral rods or bars.

17. The crown assembly according to claim 15, wherein said crown has three planar contact surfaces on equally-spaced radial arms.

18. The crown assembly according to claim 17, wherein the extension unit comprises;

(a) said pair of coaxial inner and outer tubes joined by said lower coupling ring;

(b) said free end of said outer tube fitted with said outward-facing flange;

(c) said pair of coaxial inner and outer tubes interposed between said free end of said headjoint tube and said crown, and adapted to be positioned coaxial to and interior to said headjoint tube;

(d) an intermediary tube of shorter length than said pair of coaxial inner and outer tubes placed coaxial to and between said pair of coaxial inner and outer tubes, joined at the end facing said lower coupling ring to said outer tube by an upper coupling ring;

(e) a series of three equally-spaced contact tabs fitted to the free end of each of the three tubes, forming a total of nine contact tabs;

(f) said nine contact tabs arranged in three concentric series in the same plane, each series angularly spaced with respect to the other two, resulting in a contact tab of one series lying in line with spaces between adjacent contact tabs in the other two series;

(g) said three planar contact surfaces of said crown so adapted to make tripartite contact with said series of three equally-spaced contact tabs fitted to a selected individual tube of said three tubes when said crown is rotated to each of three predetermined index positions; and (h) said tripartite contact formed when said internally threaded stem of said crown is received on said externally threaded outer stem of said stopper, drawing said outward-facing flange on said outer tube against the free end of said headjoint tube;

whereby the vibrational length of said extension unit can be varied between three predetermined lengths as said crown is rotated to each of said three predetermined index positions; and said vibrational length from said embouchure to said crown is extended by said vibrational length of said extension unit, and said lateral length from said embouchure to said crown is essentially the same as that of said headjoint without said extension unit installed.

19. The extension unit according to claim 18, wherein one or more of said three tubes is replaced with an array of folded lateral rods or bars.

20. A headjoint for an instrument of the flute family having the crown assembly of claim 7 installed on said headjoint.

* * * * *